US007571778B2

(12) United States Patent
Rock

(10) Patent No.: US 7,571,778 B2
(45) **Date of Patent: *Aug. 11, 2009**

(54) METHOD OF DRILLING A BORE HOLE

(75) Inventor: Douglas Lawrence Rock, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/876,371

(22) Filed: Oct. 22, 2007

(65) Prior Publication Data

US 2008/0035378 A1 Feb. 14, 2008

Related U.S. Application Data

(63) Continuation of application No. 10/192,833, filed on Jul. 10, 2002, now Pat. No. 7,284,623.

(60) Provisional application No. 60/309,440, filed on Aug. 1, 2001.

(51) Int. Cl.
*E21B 7/00* (2006.01)
*E21B 47/00* (2006.01)

(52) U.S. Cl. ..... 175/57; 175/40

(58) Field of Classification Search ..... 175/38–40, 175/45, 46, 50, 57, 61, 62; 703/6, 9, 10
See application file for complete search history.

(56) References Cited

U.S. PATENT DOCUMENTS

| | | | | | |
|---|---|---|---|---|---|
| 1,873,757 | A * | 8/1932 | Gilman | 175/417 |
| 4,373,592 | A * | 2/1983 | Dellinger et al. | 175/61 |
| 4,883,132 | A * | 11/1989 | Tibbitts | 175/65 |
| 6,070,677 | A * | 6/2000 | Johnston, Jr. | 175/57 |
| 6,109,368 | A * | 8/2000 | Goldman et al. | 175/39 |
| 7,284,623 | B2 * | 10/2007 | Rock | 175/57 |
| 2004/0143427 | A1 * | 7/2004 | Huang et al. | 703/10 |

* cited by examiner

*Primary Examiner*—Hoang Dang
(74) *Attorney, Agent, or Firm*—Osha Liang LLP

(57) ABSTRACT

A method to drill a borehole includes drilling the borehole through an overburden with a drill bit selected to optimize a drilling performance parameter and drilling the borehole through a production zone with another drill bit selected to optimize a production performance parameter.

10 Claims, 2 Drawing Sheets

METHOD OF DRILLING A BORE HOLE

CROSS-REFERENCE TO RELATED APPLICATIONS

The present Application is a continuation of U.S. patent application Ser. No. 10/192,833(now U.S. Pat. No. 7,284,623) filed on Jun. 10,2002 which darned priority to U.S. patent application Ser. No. 60/309,440, filed on Aug 1, 2001.

BACKGROUND OF THE INVENTION

1. Field of the Invention

The invention is related generally to the field of drilling boreholes through the earth. More specifically, the invention relates to methods for selecting and designing drill bits for drilling such boreholes so that petroleum fluid extraction from subsurface formations is optimized.

2. Description of the Related Art

In drilling oil and gas wells, drill bits are used to drill a borehole through earth formations. The formations include "overburden", which generally is all the formation layers above a producing formation. The producing formation includes a deposit of oil and/or gas in pore spaces therein. Typically, the vast majority of the length of the hole, in a conventional vertical or near vertical well is through the overburden. The drill bits are usually selected based on expected drilling performance criteria, such as maximum rate of penetration, maximum footage drilled per bit, minimum cost to drill to the target depth, etc. The focus is to drill the borehole as fast as possible and with as few "trips" (operations in which an entire drilling tool assembly is removed from the wellbore) as possible.

However, once the borehole has been drilled to the top of the producing zone, various production performance criteria come into play that are not as important when drilling through the overburden. The portion of the borehole through the production zone is the most critical because this is the portion through which the oil and/or gas will ultimately be produced. If this portion of the borehole is not drilled and conditioned properly, the economics of the well and the entire reservoir may be substantially impaired. For this reason, borehole operators are willing to sacrifice drilling performance to some extent to ensure that the condition of the borehole through the production zone is optimized.

For example, it is desirable for the permeability of the earth formations proximate the wall of the borehole not be diminished. Typically, however, solids from a drilling fluid ("mud") used to drill the borehole, and/or formation drill cuttings become embedded into the formation near the borehole wall and create a "skin" that can impede the flow of oil and/or gas into the borehole. If the cuttings are large and remain large as they travel up the bore hole they are less likely to embed in the formation near the borehole wall and the degree of skin formation is lessened. Smaller cuttings, that have a higher propensity for contributing to skin, may be caused by a particular bit that creates small cuttings in the particular producing formation. Often the hydraulics and/or design of the drill bit cause initially large cuttings to be reground by the bit during drilling, thereby reducing the cuttings to a size that increases skin formation.

In view of the more critical nature of the borehole through the producing zone and the differing parameters that are sought to be optimized, a need exists for a drilling method that changes the bit selection criteria once the production zone has been reached.

SUMMARY OF THE INVENTION

One aspect of the invention is a method for drilling a borehole through a production zone underlying an overburden of various earth formations. The method includes drilling the borehole through the overburden with at least one drill bit adapted to optimize at least one drilling performance parameter, and then drilling the borehole through at least part of the production zone with at least one drill bit adapted to optimize at least one production performance parameter.

Another aspect of the invention is a method for selecting parameters to optimize a production performance parameter in a drilled borehole. A method according to this aspect includes selecting initial bit design parameters and initial drilling operating parameters. Drilling is simulated in a selected earth formation, the simulating includes determining at least one parameter related to production performance in the selected earth formation. At least one of the initial bit design parameters or at least one of the initial drilling operating parameters is adjusted and the simulating is repeated. The adjusting the at least one parameter and the simulating are then repeated until the at least one parameter related to production performance is optimized.

Other aspects and advantages of the invention will become apparent from the description and claims which follow.

DETAILED DESCRIPTION

Figure 1:
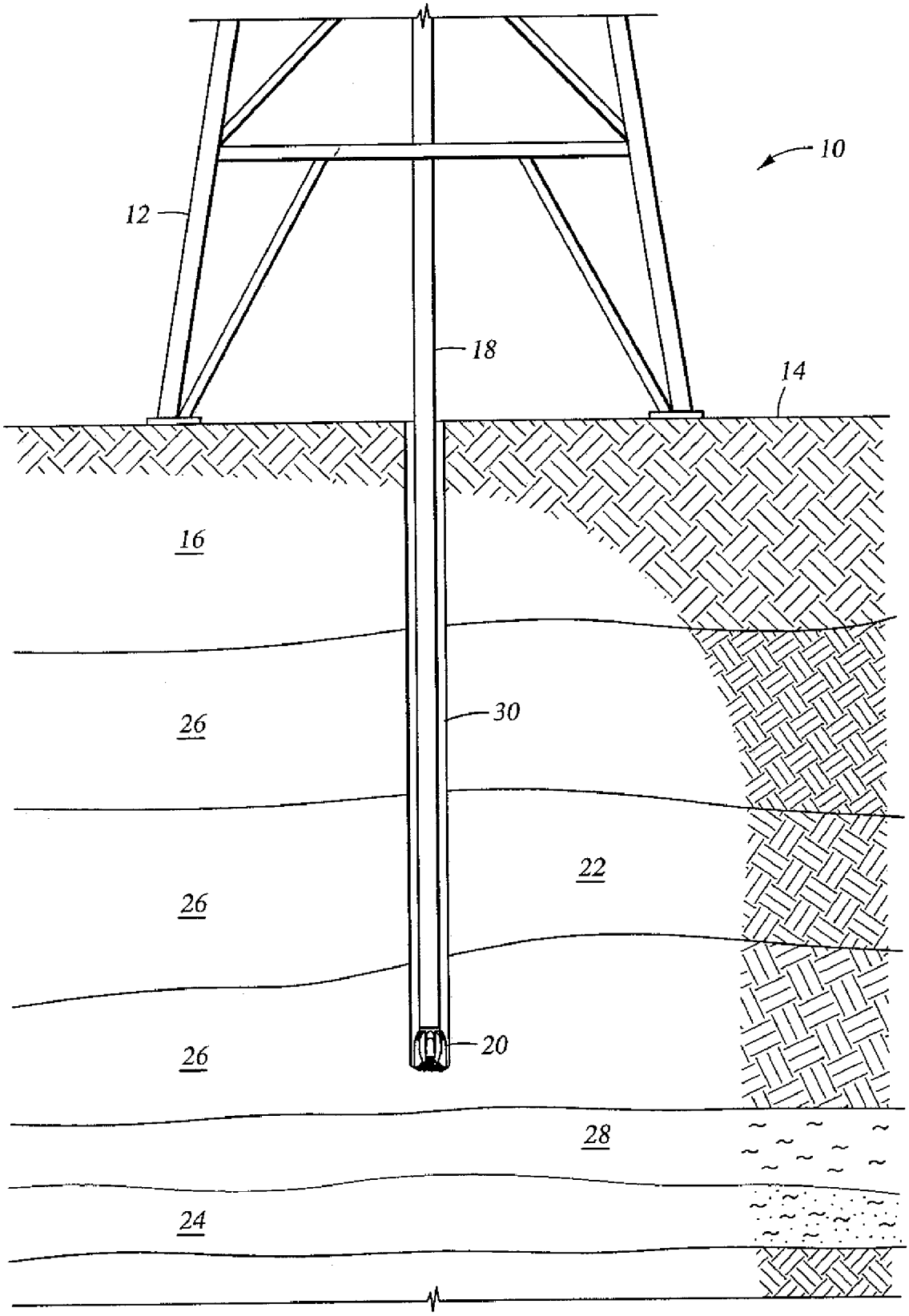
FIG. 1 is a schematic of an oil and/or gas well.

FIG. 1 shows one example of an oil and/or gas well 10 being drilled through the earth. A drilling rig 12 located on the surface 14 of the earth 16 is used to control a drilling tool assembly, or drill string 18, for drilling through the earth. A drill bit 20 is coupled to the end of drill string 18 to drill borehole 30 through the earth. An oil and/or gas deposit, called a reservoir 24, is located in the earth at a particular depth. Over this reservoir 24 is an overburden 22, which usually consists of several different lithologies or types and/or compositions of earth formations 26. The reservoir 24 is located within a particular earth formation which contains a production zone 28, from which oil and/or gas is expected to flow into the borehole 30 when it is ultimately drilled through the production zone 28.

Figure 2:
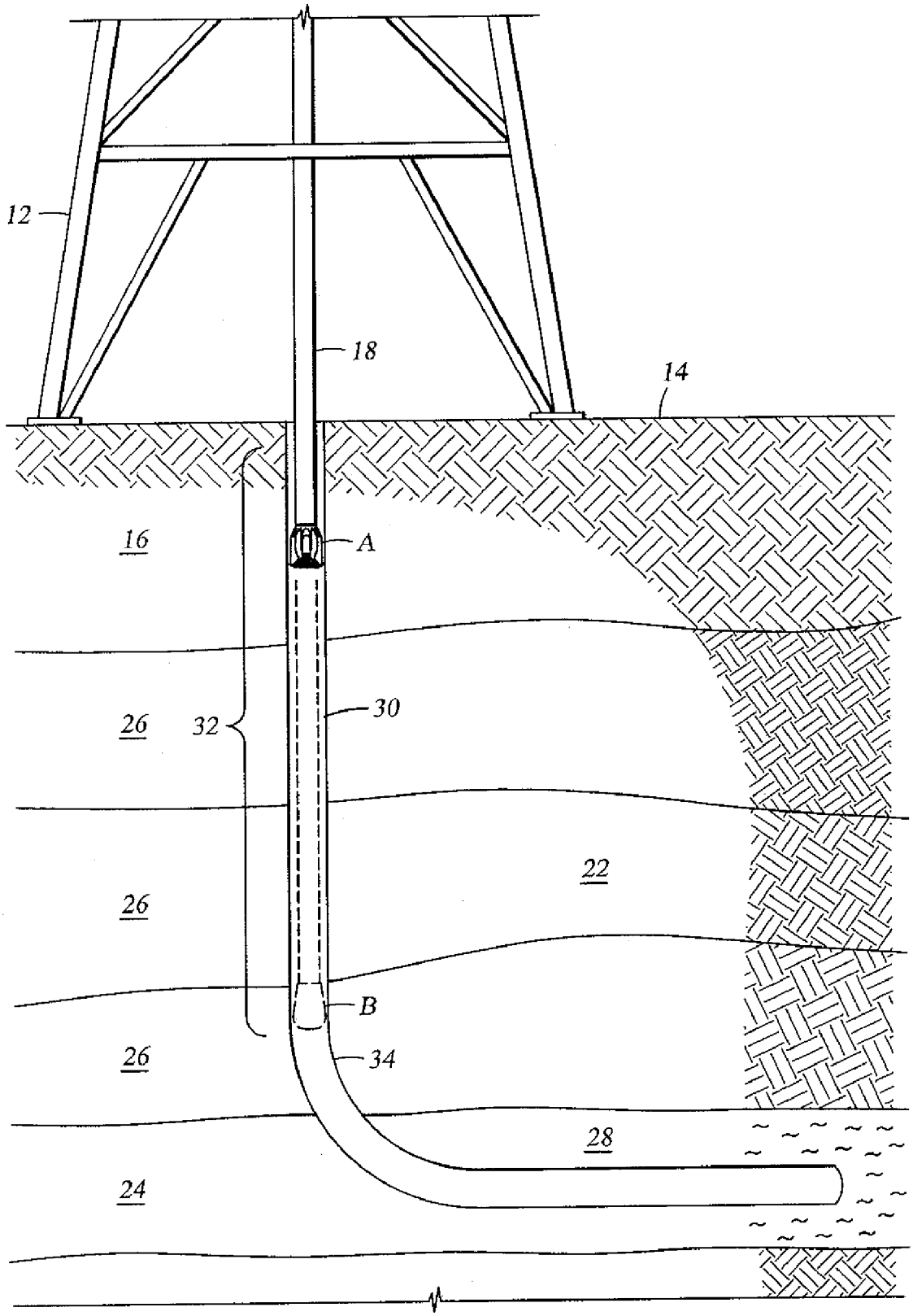
FIG. 2 is a schematic of another configuration of an oil and/or gas well.

FIG. 2 shows another type of borehole that is highly inclined or horizontal as it passes through the production zone 28 in order to extend the length of the borehole 30 through the production zone 28. Extending the length of the borehole 30 through the production zone 28 is known in the art to increase the useful rate at which oil and/or gas flows into the borehole 30 from the production zone 28.

In a method according to one aspect of the invention, a first portion 32 of the borehole 30 is drilled to a changeover point 34 by at least one, and sometimes a first series of drill bits that are selected generally to optimize at least one, and more often a plurality of drilling performance parameters for the particular formations 26 that make up the overburden 22. For example, a first drill bit, shown at A, may be a "medium" (referring to hardness, for example) formation roller cone drill bit used to drill the relatively shallow part of the first portion 32. A second drill bit, shown at B, which may be a hard formation "drag" (fixed cutter) bit is used to drill the lower portion of the overburden 22. Drill bits A and B are selected to optimize at least one drilling performance parameter. These parameters include, for example, maximum total footage (drilled interval) for each bit A, B, minimum cost to reach the base of the overburden 22, maximum rate of penetration of the overburden 22, and overall smoothness of the profile of the borehole 30, among others. In various embodiments of a method according to the invention, any one or more drilling performance parameters may be optimized by selection of the drill bits A, B used to drill the overburden 22. Alternatively, the drill bits themselves may be designed to optimize one or more drilling performance parameters through the overburden 22. Although the foregoing example shows bit A as being a roller cone bit, and bit B as being a fixed cutter bit, it should be clearly understood that any bit or bits used to drill the overburden may be either fixed cutter or roller cone type. The type of bit selected will be related to the characteristics of the formations in the overburden 22, and the drilling performance parameters that are selected for optimization. Accordingly, any individual or combination of the foregoing bit types used to drill the overburden is within the scope of the invention. Furthermore, in some cases only one type of drill bit, or even only one drill bit, may be used to drill the overburden so as to optimize at least one drilling performance parameter. Accordingly, the scope of the invention includes using only one drill bit adapted to optimize at least one drilling performance parameter in any or all the formations above the reservoir 28.

Although a bit selected to optimize a drilling performance parameter, such as bit B, may be able to be used past a changeover point 34, in a method according to the invention, when the borehole 30 is drilled to the changeover point 34, the drill string (18 in FIG. 1) with the bit (20 in FIG. 1) attached thereto is removed from the borehole 30 and a drill bit adapted to drill the production zone is then coupled to the drill string to drill through the production zone. The bit used to drill through the production zone 28 is selected and/or designed to optimize at least one production performance parameter. Production performance parameters include, for example, reducing or minimizing skin damage, optimizing cutting size for screening from mud, and increasing the surface area of the borehole wall.

Reducing skin damage to the reservoir 28 may be accomplished, for example, by selecting the drill bit and/or designing the drill bit so that the drill cuttings generated thereby are relatively large size, so that the cuttings are less likely to be embedded into the formations near the wall of the borehole 30. Methods for designing and/or selecting a fixed cutter bit to provide particular cuttings size are well known in the art. See for example, U.S. Pat. No. 4,815,342 issued to Brett et al. with respect to such methods as they related to fixed cutter bits. Methods for designing and/or selecting a roller cone drill bit to optimize drill cuttings size are disclosed in pending U.S. patent application Ser. No. 09/524,088, filed on Mar. 13, 2000 and entitled, Method for Simulating Drilling of Roller Cone Drill Bits and its Application to Roller Cone Bit Design and Performance. Generally speaking, the methods disclosed in the Brett et al. '342 patent and the '088 application can include calculating a geometry of the drill cuttings, among other drilling factors, for a given set of drill bit design parameters. In a method according to one embodiment of the invention, an initial set of bit design parameters and drilling operating parameters is selected. These parameters include, for example, size, type, placement and number of cutting elements, bit diameter, axial force and rotary speed applied to the bit. In these methods, a simulation of the interaction between the drill bit, as designed, and earth formations having characteristics similar to the earth formation of interest (which in the present case is the production interval) is numerically calculated or otherwise performed. The interaction includes generating drill cuttings having a geometry related to the bit design and drilling operating parameters and related to the formation properties. In the invention, at least one bit design parameter or drilling operating parameter is adjusted, the simulation is repeated, and the drill cuttings are analyzed with respect to desired geometry (which can include drill cuttings size). The at least one parameter is again adjusted, the simulation is again performed, and the simulated cuttings are again analyzed. This process is repeated until the drill cuttings have a desired geometry, which may include a selected minimum size. Generally speaking, methods according to this aspect of the invention include selecting an initial set of bit design and drilling operating parameters, and simulating drilling a selected earth formation. The simulation of drilling includes in its result at least one parameter related to production performance in the selected earth formation. The production parameter may include, for example, cuttings size, and as will be explained, shape and/or surface area of the wall of the borehole. At least one of the drilling operating parameters or the bit design parameters is adjusted and the simulation is repeated. This process is repeated until the production performance related parameter is optimized.

Reducing skin damage may also be accomplished by optimizing the bit hydraulics so that the drill cuttings are rapidly moved up borehole from the bit to avoid recurring grinding of the cuttings. One way to optimize hydraulics is to design and/or select the drill bit so that a size of an annular space between the borehole wall and the exterior of the bit and drill string undergoes few and/or smooth changes in size. A smoothly changing and/or constant size annular space reduces turbulence in the flow of the drilling mud, which may reduce the incidence of drill cuttings being forced back to the cutting surface of the drill bit, thus being reground by the bit. Reducing skin damage may also be performed by conditioning of the borehole side wall to remove or interrupt any skin formed.

Aside from minimizing skin damage, optimizing cuttings removal from the drilling mud is one type of production performance parameter by itself. The larger the cuttings, the easier they are to remove from the drilling mud, which lowers the "added solids rate" (rate at which drilling solids are introduced into the drilling mud) and increases the efficiency of treatment of the drilling mud. Cuttings size can be maximized, as explained previously herein by appropriate selection and/or design of the drill bit for the characteristics of the particular production zone.

Another production performance parameter which may be optimized includes the overall surface area of the borehole within the production zone. In some embodiments, the surface area of the borehole wall in the production zone may be increased by scoring, by drilling spiraling grooves, etc. This increases the surface area through which gas and/or oil can pass into the borehole from the production zone. By contrast, the portion of the borehole drilled through the overburden 22 is preferably smooth and has a gradually transitioned hole profile. In some embodiments of a method according to the invention, drilling the wellbore can be simulated as explained above with respect to drill cuttings optimization. The configuration of the borehole wall will typically be determined as a result of the simulating. Bit design and/or drilling operating parameters can be adjusted, and the simulating repeated until a surface area of the borehole wall is optimized.

If the borehole 30 is to be drilled deeper or laterally past the production zone and into non-producing formation, drill bits may be used at that point which are selected and/or designed to optimize at least one drilling performance parameter, just as in the case of the overburden. Should the borehole be extended still further to penetrate another producing zone, then a drill bit can be selected and/or designed to optimize any one or more of the foregoing production performance parameters, for example.

It is possible that drill bits selected and/or designed to optimize a production performance parameter will provide inferior drilling performance as compared to drill bits selected and/or designed to optimize a drilling performance parameter in any particular formation. Because of the criticality of the borehole condition within the producing zone, a sacrifice in drilling performance may be more than compensated by an increase in the production condition of the borehole. Changeover point 34 is preferably right before the production zone is reached, however, if a drill bit has to be pulled (replaced due to wear or failure) before the production zone is reached, a bit designed and/or selected to optimize the production performance parameter may be installed at that time if it is anticipated that this bit will last until the desired length of borehole is drilled through the production zone.

Alternatively, the changeover point 34 may be within the production zone 28 itself in certain cases, such as where a horizontal or highly inclined borehole is drilled through the production zone 28. In such cases, only a portion of the entire borehole interval drilled through the production zone (a "production window") is actually used for producing oil and/or gas, so a drill bit selected to optimize a drilling performance parameter may be used to drill through a portion of the production zone which is not to be used for producing the oil and/or gas. As long as the changeover point is at a position prior to the actual production window, then the benefit of the method of the invention may be obtained in that a bit is used in the production window that is selected and/or designed to optimize a production performance parameter.

While the present invention has been described with reference to a limited number of embodiments, it will be apparent to those skilled in the art that certain modifications or additions may be made to the invention which are still within the scope of the following claims. Accordingly the invention shall be limited in scope only by the claims which follow.

What is claimed is:

1. A method to drill a borehole, the method comprising:

drilling the borehole through an overburden with a drill bit selected to optimize a drilling performance parameter; and drilling the borehole through a production zone with another drill bit selected to optimize a production performance parameter.

2. The method of claim 1, wherein optimizing the production performance parameter comprises minimizing skin damage in the production zone.

3. The method of claim 1, wherein optimizing the production performance parameter comprises increasing a surface area of a borehole wall in the production zone.

4. The method of claim 1, wherein optimizing the production performance parameter comprises optimizing a drill cutting size.

5. The method of claim 4, wherein optimizing the drill cutting size comprises optimizing to facilitate removal thereof from the borehole.

6. The method of claim 4, wherein optimizing the drill cutting size comprises optimizing to facilitate removal thereof from a drilling mud.

7. The method of claim 1, wherein optimizing the drilling performance parameter comprises optimizing a rate of penetration.

8. The method of claim 1, wherein optimizing the drilling performance parameter comprises optimizing a total footage drilled.

9. The method of claim 1, wherein optimizing the drilling performance parameter comprises optimizing a cost of drilling to a selected depth.

10. The method of claim 1, wherein optimizing the drilling performance parameter comprises optimizing a profile of the borehole.

* * * * *